United States Patent [19]

Inoue et al.

[11] Patent Number: 4,493,656

[45] Date of Patent: Jan. 15, 1985

[54] TILT-UP ANGLE SENSING SYSTEM FOR INBOARD-OUTBOARD DRIVES

[75] Inventors: Seiji Inoue; Norimichi Harada, both of Shizuoka, Japan

[73] Assignee: Yamaha Hatsudoki Kabushiki Kaisha, Japan

[21] Appl. No.: 589,952

[22] Filed: Mar. 15, 1984

Related U.S. Application Data

[63] Continuation of Ser. No. 378,849, May 17, 1982, abandoned.

[30] Foreign Application Priority Data

Jun. 26, 1981 [JP] Japan ..... 56-99478

[51] Int. Cl.[3] ..... B63H 5/12

[52] U.S. Cl. ..... 440/2; 440/53; 340/689

[58] Field of Search ..... 440/1, 2, 42, 53; 114/144 R; 340/987, 689

[56] References Cited

U.S. PATENT DOCUMENTS

| | | | |
|---|---|---|---|
| 1,400,199 | 12/1921 | Wood | 340/987 |
| 3,181,494 | 5/1965 | Kiekhaefer | 440/53 |
| 3,601,082 | 8/1971 | Wise | 440/2 |
| 3,797,449 | 3/1974 | Carpenter | 440/2 |
| 3,844,247 | 10/1974 | Collis | 440/2 |
| 4,005,674 | 2/1977 | Davis | 440/1 |
| 4,051,801 | 10/1977 | Woodfill | 440/1 |
| 4,290,044 | 9/1981 | Ishikawa | 340/689 |

FOREIGN PATENT DOCUMENTS

| | | |
|---|---|---|
| 5785203 | 10/1979 | Japan . |
| 55-85203 | 6/1980 | Japan . |

*Primary Examiner*—Trygve M. Blix
*Assistant Examiner*—Patrick Young
*Attorney, Agent, or Firm*—Ernest A. Beutler

[57] ABSTRACT

A position sensing unit for the outboard drive of a marine engine for providing an indication of the trim angle of the drive. The position sensing unit comprises a sensing device that is carried by the outboard drive outboard of the transom and an angle reading device that is positioned inboard of the transom. A connecting device transmits a position signal from the sensing device to the angle reading device so that the angle reading device may be positioned remotely from the outboard drive.

5 Claims, 2 Drawing Figures

TILT-UP ANGLE SENSING SYSTEM FOR INBOARD-OUTBOARD DRIVES

This application is a continuation of application Ser. No. 378,849, filed May 17, 1982, now abandoned.

BACKGROUND OF THE INVENTION

This invention relates to a tilt-up angle sensing system for inboard-outboard drives and more particularly to an improved sensing system for the tilt angle of such a unit.

In many instances it is desirable to provide an arrangement wherein the trim angle of an outboard drive unit can be adjusted during operation of the boat. Many boats, therefore, employ an arrangement wherein the outboard drive unit may have its trim angle adjusted during operation. For this purpose, the propelling unit is mounted on the transom for pivotal movement about a generally horizontally-extending axis. A remote control mechanism such as an electric motor, hydraulic cylinder or the like may be employed for effecting adjustment of the trim angle during running. When such an arrangement is employed, it is desirable to provide an indicator in proximity to the operator so that he can determine the actual trim angle of the outboard drive unit. This can be done by providing a sensing unit, such as an electrical sensor, that reads the trim angle. However, due to the mounting arrangement of the outboard drives, it is difficult to provide such a sensing unit in a convenient location. Furthermore, if the sensing unit is mounted outboard of the transom, it will be exposed to the water in which the boat is operated which can cause corrosion or other malfunction. This problem is particularly acute when operating in salt water. Because of the provision of the pivotal support for the trim adjustment and, in addition, the necessity to provide for steering by pivotal movement about a vertically-extending axis, the mechanisms for providing these supports and permitting these controls does not afford a convenient location, in all instances, for a sensing unit.

It is, therefore, a principal object of this invention to provide an improved trim angle sensing device for an inboard-outboard It is another object of the invention to provide a trim angle sensing unit wherein the critical components are positioned where they are not likely to be subjected to damage or corrosion.

It is a further object of the invention to provide an improved, accurate trim sensing system that is well protected.

SUMMARY OF THE INVENTION

This invention is adapted to be embodied in a position sensing unit for an outboard drive to indicate its angular position relative to the transom of a boat. Sensing means are carried by the outboard drive and movable therewith. Angle reading means are positioned on the opposite side of the transom from the sensing means and connecting means transmit a position signal from the sensing means to the angle reading means.

DETAILED DESCRIPTION OF THE PREFERRED EMBODIMENT

Figure 1:
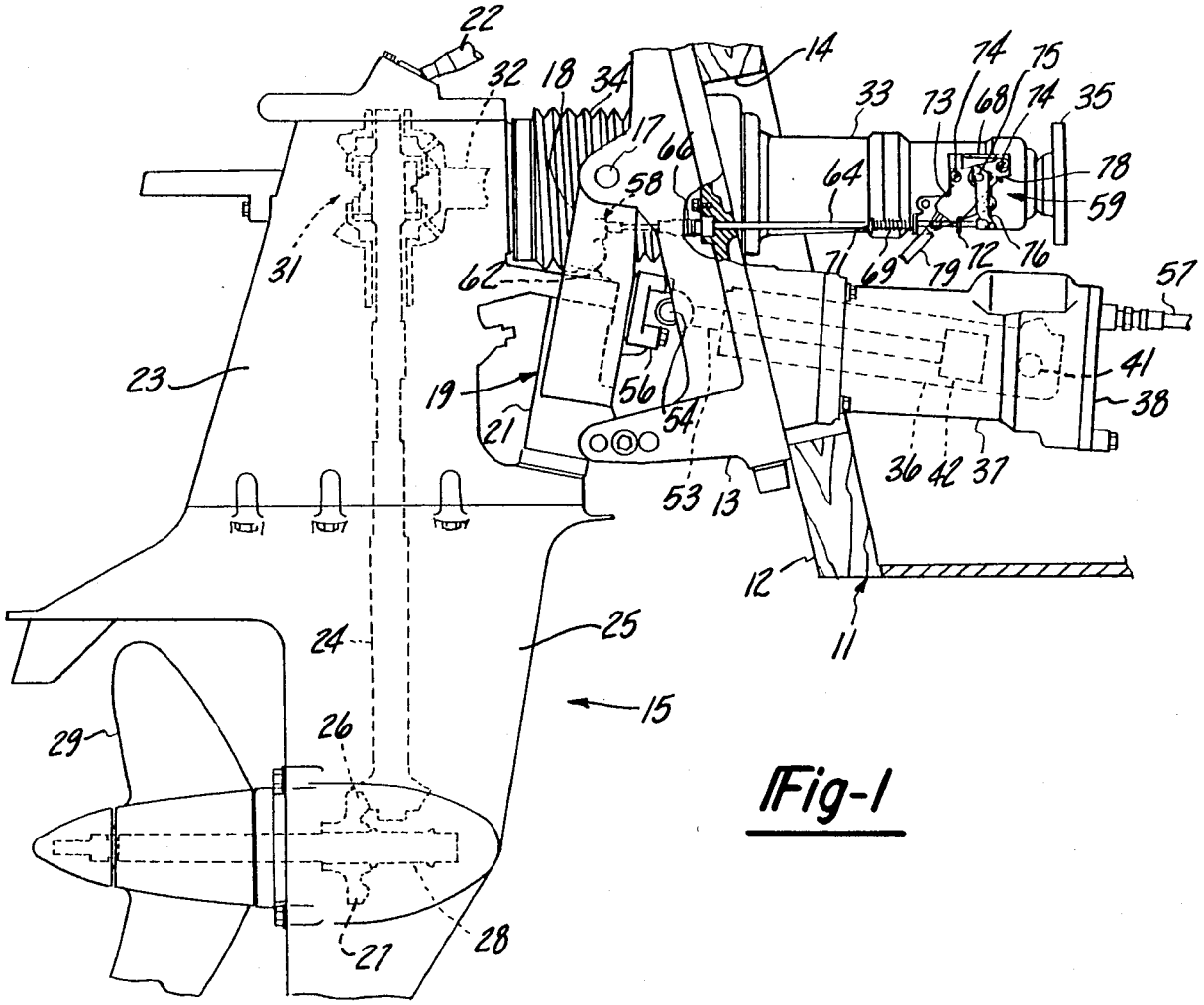
FIG. 1 is a side elevational view of an outboard drive embodying this invention, with portions broken away.

In the drawings, the reference numeral 11 indicates generally a watercraft that is adapted to be used in conjunction with the invention. The watercraft 11 has a stern plate 12 to which a transom plate 13 is affixed in a known manner in proximity to an opening 14 in the stern plate 12. The transom plate 13 supports, in a manner to be described, an outboard drive unit, indicated generally by the reference numeral 15.

The transom plate 13 has a pair of rearwardly-extending lugs 16 (only one of which appears in the drawings) that journal pivot pins 17 about a generally horizontally-extending axis. The pivot pins 17 are, in turn, affixed or journalled in upwardly-extending portions 18 of a steering fork assembly, indicated generally by the reference numeral 19. The steering fork assembly 19 is formed with a cylinder portion 21 that journals the outboard drive unit 15 for steering movement about a generally vertically-extending axis in a known manner. Steering movements are transmitted to the outboard drive unit 15 by means of a suitable steering mechanism, including a steering rod 22 that is connected to the outboard drive unit 15 by means of a ball joint connection, in a known manner.

The outboard drive unit 15 includes a driveshaft housing 23 in which a vertically-extending driveshaft 24 is supported for rotation. The driveshaft 24 has affixed to its lower end, within a lower unit 25, a bevel gear 26 which meshes with a bevel gear 27 that is affixed to a propeller shaft 28 that is journalled in the lower unit 25. The propeller shaft 28 drives a propeller 29.

Cooperating with the upper end of the driveshaft 24 is a forward, neutral, reverse transmission mechanism of a known type and indicated generally by the reference numeral 31. The transmission 31 is driven by an input shaft 32. The input shaft 32 is, in turn, driven by a driveshaft that extends through a cylindrical housing 33 that is affixed to the transom plate 13 and which extends forwardly through the stern opening 14. This driveshaft is coupled to the input shaft 32 by means of a universal joint (not shown), which is protected within a flexible bellows 34 that extends between the driveshaft housing 23 and the transom plate 13. A suitable clutch mechanism may also be enclosed within the cylindrical housing 33 and is driven by the flange 35 of a coupling which is, in turn, connected to the output shaft of the associated engine (not shown).

The trim and tilting movement of the outboard drive unit 15 about the pivot pins 17 is controlled by means of a suitale actuating device, such as a hydraulic cylinder assembly 36 that is positioned within a cylindrical housing 37 that is affixed to and extends forwardly from the transom plate 13. The housing 37 has its forward end enclosed by means of a cover plate 38. The cover plate 38 has a pair of trunion portions 39 that extend within the cylinder housing 37 and which support pivot pins 41 which, in turn, pivotally support the cylinder assembly 36.

A piston 42 is supported for reciprocation within the cylinder assembly 36 and has a piston rod 53 that is connected by means of a pivot pin 54 to a pair of forwardly extending ears 55 formed on a plate 56. The plate 56 is affixed in any suitable manner to the steering fork 19 so that extension and retraction of the piston rod 53 will effect pivotal movement of the drive unit 15 about the pivot pins 17.

The piston 42 divides the cylinder assembly 36 into two separate fluid chambers. A hydraulic line 57 (only one of which appears in the drawings) communicates each of these chambers with a suitable pump and control mechanism positioned within the reach of the operator. Thus, by operating this pump and control mechanism, one chamber may be pressurized and the other evacuated so as to effect pivotal movement of the drive unit 15 about the pivot pins 17 in a known manner.

A sensing mechanism is provided to give the operator an indication of the tilt angle of the drive unit 15 about the axis defined by the pivot pins 17. This sensing mechanism is constructed in such a way that critical components will not be positioned externally of the stern plate 12 and also so that the unit can be conveniently accommodated within the various components of the drive unit 15 and its supporting mechanism. The sensing unit is comprised of a sensing means, indicated generally by the reference numeral 58, which is positioned outboard of the stern plate 12, an angle reading means, indicated generally by the reference numeral 59 which is positioned inboard of the stern plate 12, and a connecting means, indicated generally by the reference numeral 61, for transmitting a signal from the sensing means 58 to the angle reading means 59.

The sensing means 58 includes a projection 62 that is formed integrally on one of the fork arms 18 adjacent the pivot pin 17. The projection 62 is adapted to cooperate with a resilient cap 63 that is screwed onto one end of an elongated connecting rod 64 which comprises the connecting means 61. The rod 64 extends through the transom plate 13 and is slidably supported at its rearward end by means of a bearing 65 that is carried by the transom plate 13. An elastomeric boot 66 surrounds the rearwardly projecting portion of the rod 64 so as to protect the bearing 65 from the ingress of water and other foreign materials and also to prevent other leakage in this area.

The forward end of the rod 64 is slidably supported in an outstanding arm 67 of an L-shaped bracket 68 that is affixed to the cylindrical housing 33 in a suitable manner. In this manner, the rod 64 extends generally parallel to the axis of the cylinder housing 33. A coil compression spring 69 encircles the rod 64 and engages the bracket arm 67 and a washer 71 that is affixed to the rod 64 so as to continuously urge the cap 63 into engagement with the projection 62. A second washer 72 is affixed to the rod 64 on the opposite side of the bracket arm 67 so as to limit the degree of maximum extension of the rod 64.

The angle reading means 59 is comprised of a sensing unit 73 that is affixed to the bracket 68 by means of bolts 74. The sensing unit 73 may be of any known type and preferably comprises an electrical sensing device which provides an electrical signal indicative of the angle of the drive unit 15 relative to the stern plate 13 by means now to be described.

The sensing unit 73 has an input shaft 75 to which an arm 76 is affixed. A resilient cap 77 is screwed onto the adjacent end of the control rod 64 and engages the arm 76 for rotating the shaft 75 in response to tilting movement of the drive unit 15. A torsional spring 78 encircles the shaft 75 and engages the lever 76 for maintaining the lever 76 in engagement with the cap 77.

An electrical conduit 79 extends from the sensing unit 73 to an appropriate indicator (not shown) located in proximity to the motorcraft operator. The sensing unit 73 may provide either a voltage, current or digital signal for operating the indicator, as is well known.

Figure 2:
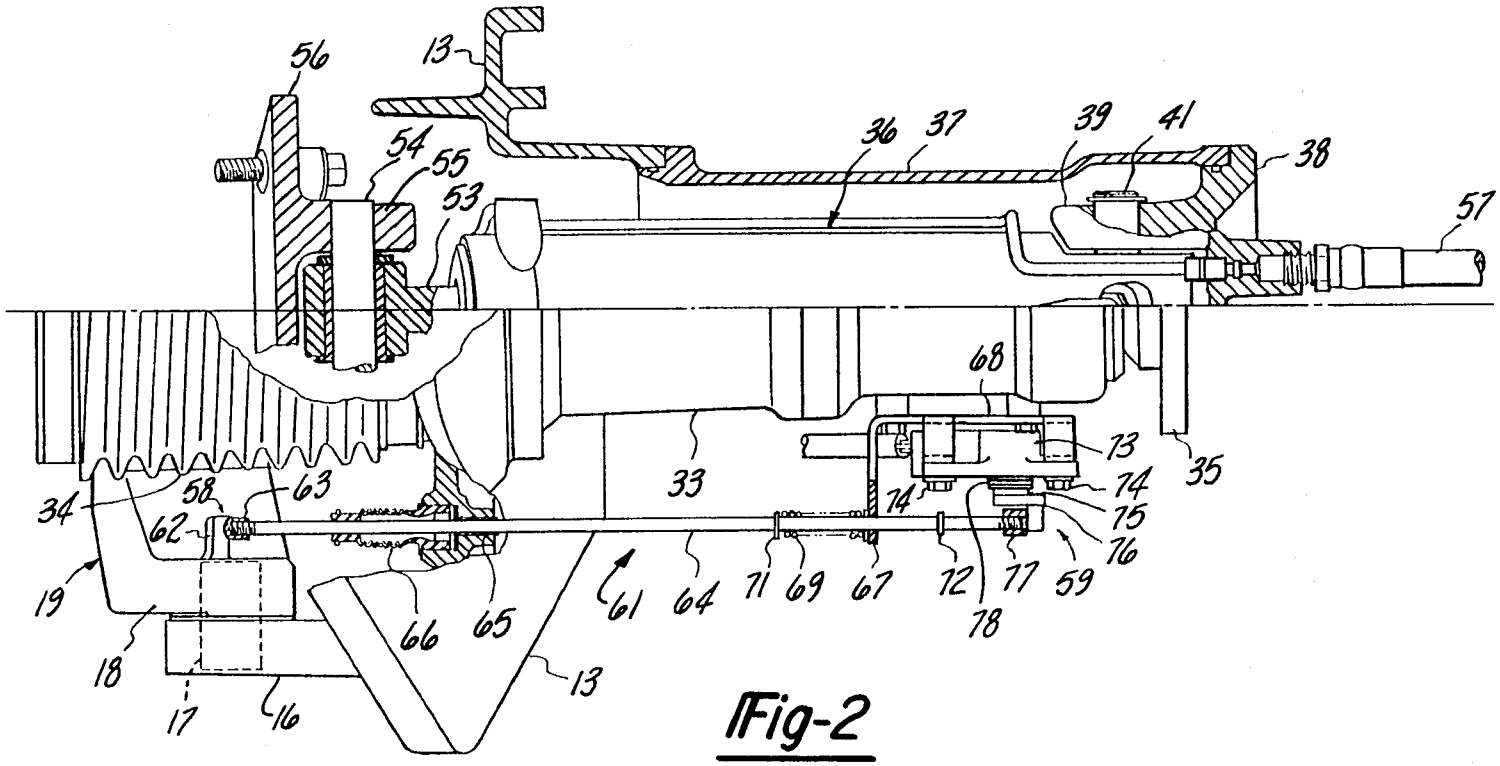
FIG. 2 is an enlarged top plan view, with portions broken away and other portions shown in section, of the drive unit and sensing arrangement.

In operation, if the drive unit 15 is adjusted upwardly through operation of the hydraulic cylinder assembly 36 by pressurizing the head side of the piston 42 to drive the piston rod 53 outwardly and pivot the drive unit 15 in a clockwise direction about the pivot pins 17, the control rod 64 will be urged to the left as shown in FIG. 2 by the spring 69. That is, the cap 63 will follow the movement of the projection 62 in response to the degree of angular movement. The cap 77 will tend to move away from the lever 76; however, the torsional spring 78 will cause the lever 76 to pivot and follow the movement of the cap 77. Thus, an appropriate electrical signal will be transmitted through the conductor 79 from the sensing unit 73 to indicate to the operate the actual angular position of the drive unit 15.

If the pivotal movement is in the opposite direction, pressure is applied to the piston rod side of the piston 42 so as to cause pivotal movement about the pivot pins 17 in a counterclockwise direction. When this occurs, the projection 62 will urge the rod 64 to the right against the action of the spring 79. In a like manner, the lever 76 will be rotated in opposition to the action of the torsional spring 78 and again an appropriate signal will be provided to the operator.

It should be readily apparent that the use of the control rod 64 permits the mounting of the relatively fragile sensing unit 73 internally of the transom plate 13 so that it will be free of contamination from water or other foreign materials. Also, because of the inboard mounting of the sensing unit 73, it is possible to use a slightly larger sensing unit than with prior art types wherein the sensing unit was mounted outboard and had to clear all of the various components which permit tilting and steering movement of the drive unit 15. Although the use of a control rod has been described in conjunction with this embodiment, it should be readily apparent that any other type of motion transmitting mechanism such as wires, links or the like may be used for transmitting motion from the sensing unit 58 to the angle reading unit 59. Also, other then electrical angle reading units 59 may be employed within the subject matter of the invention. Various other changes and modifications may be made without departing from the spirit and scope of the invention as defined by the appended claims.

I claim:

1. A position sensing unit for an outboard drive to indicate its angular position relative to the transom of a boat including power means for adjusting the angular position of the outboard drive comprising sensing means comprising a sensing abutment member carried by said outboard drive and movable therewith, angle reading means positioned on the opposite side of said transom from said sensing means, said angle reading means comprising an input element supported for movement and a signal producing element for providing a signal indicative of the position of said input element, and connecting means comprising a slidably supported element passing through the transom and independent of the power means for transferring a position signal to said input element, said slidably supported element having a first end abuttingly engaged with said abutment member, and means providing a mechanical connection between said input element and the end of said slidably supported element for positioning said input element of angle reading means in response to the position of said sensing abutment member.

2. A position sensing unit as set forth in claim 1 further including sealing means surrounding the portion of the slidably supported member that extends through the transom for precluding the leakage of water through the transom.

3. A position sensing unit as set forth in claim 1 wherein the signal producing element of the angle reading means comprises an electrical device for providing an electrical signal.

4. A position sensing unit as set forth in claim 3 further including indicating means positioned in proximity to an operator and means for transmitting an electrical signal from the signal producing element to said indicating means so as to provide a visual indication of the angular position of the outboard drive.

5. A position sensing unit as set forth in claim 2 wherein the signal producing element of the angle reading means comprises an electrical device for providing an electrical signal.

* * * * *